US007380552B2

(12) United States Patent
Draghetti et al.

(10) Patent No.: US 7,380,552 B2
(45) Date of Patent: Jun. 3, 2008

(54) UNIT FOR FORMING A CONTINUOUS MAT OF TOBACCO

(75) Inventors: Fiorenzo Draghetti, Medicina (IT); Fausto Mengoli, Sasso Marconi (IT); Umberto Zanetti, Modena (IT)

(73) Assignee: G.D Societa'per Azioni, Bologna (IT)

( * ) Notice: Subject to any disclaimer, the term of this patent is extended or adjusted under 35 U.S.C. 154(b) by 507 days.

(21) Appl. No.: 11/014,445

(22) Filed: Dec. 16, 2004

(65) Prior Publication Data

US 2005/0155614 A1 Jul. 21, 2005

(30) Foreign Application Priority Data

Dec. 22, 2003 (IT) ..... BO2003A0767

(51) Int. Cl.
*A24C 5/14* (2006.01)

(52) U.S. Cl. ..... 131/84.3; 131/84.1

(58) Field of Classification Search ..... 131/80, 131/84.1, 84.3, 84.4, 61.1, 64.1, 110
See application file for complete search history.

(56) References Cited

U.S. PATENT DOCUMENTS 3,795,249 A 3/1974 Cristiani
4,367,758 A * 1/1983 Seragnoli ..... 131/84.3
4,741,350 A * 5/1988 Belvederi ..... 131/84.3
5,494,053 A * 2/1996 Dawson et al. ..... 131/84.1

FOREIGN PATENT DOCUMENTS

DE 1169353 4/1964
GB 813576 5/1959

* cited by examiner

*Primary Examiner*—Eric Hug
(74) *Attorney, Agent, or Firm*—Marshall, Gerstein & Borun LLP

(57) ABSTRACT

A unit for forming a continuous mat of tobacco with denser portions, wherein the mat of tobacco is formed on a suction conveyor belt looped about a return pulley and extending through two successive shredded tobacco feed stations; and wherein the return pulley, located at one of the two feed stations, has a number of radial suction seats, each for retaining a localized quantity of tobacco on the conveyor belt.

6 Claims, 1 Drawing Sheet

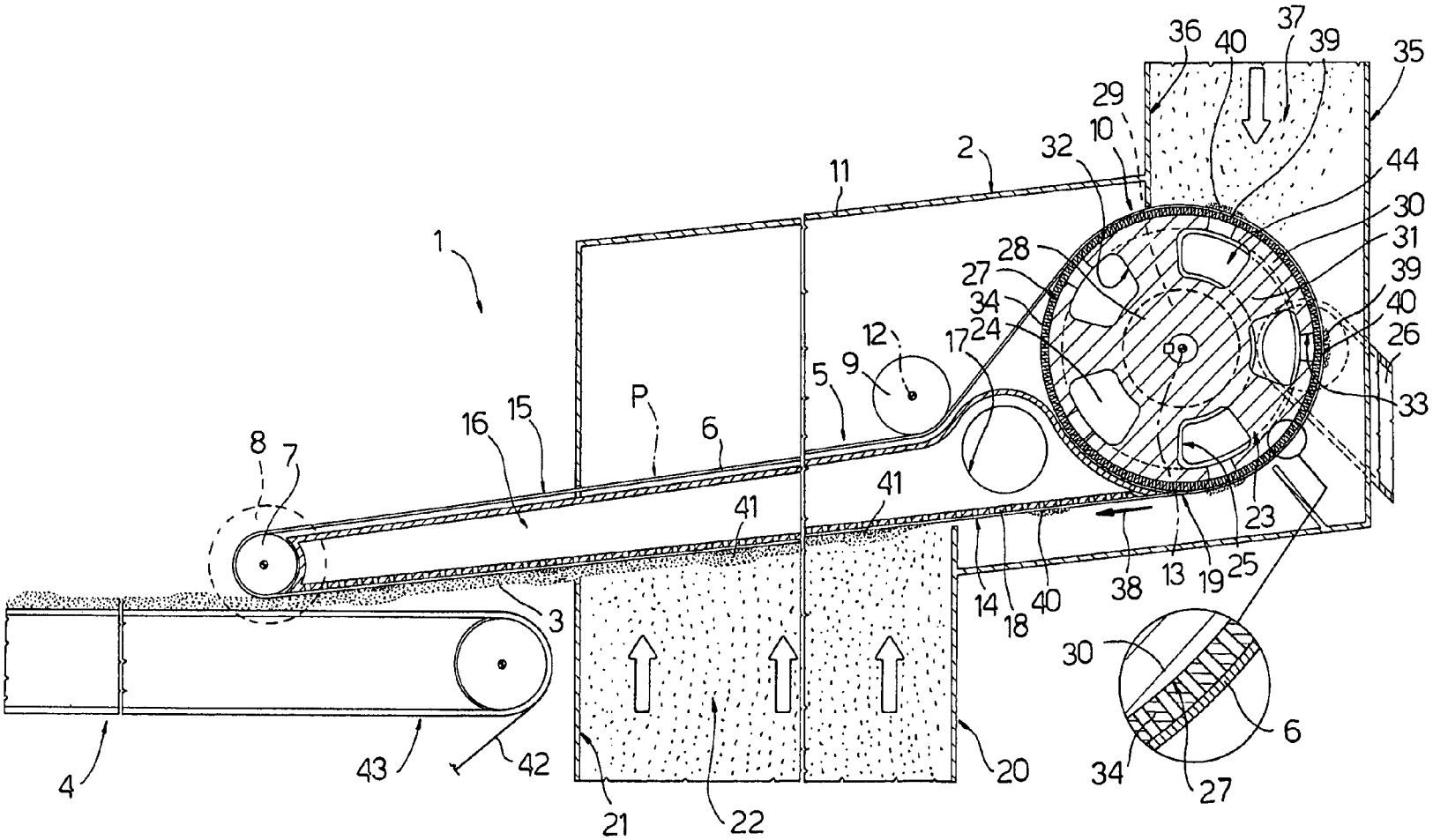
35
44
30
31
39
40
26
33
37
39
40
36
29
10
32
28
27
34
24
17
2
11
12
9
5
6
P
15
16
1
8
7
4
43
42
3
21
22
20
41
41
14
18
40
38
13
19
25
23
6
27
34
30

UNIT FOR FORMING A CONTINUOUS MAT OF TOBACCO

CROSS-REFERENCE TO RELATED APPLICATION

This application claims the benefit of Italian Patent Application Serial No. BO2003A 000767 filed Dec. 22, 2003.

BACKGROUND OF THE INVENTION

More specifically, the present invention relates to a unit of the type comprising a conveyor belt extending along a given path; feed means located along said path to feed a continuous mat of shredded tobacco onto said conveyor belt; and suction means located on the opposite side of said conveyor belt to said feed means, and cooperating with said feed means to retain said continuous mat of shredded tobacco on said conveyor belt.

In cigarette manufacturing, the continuous mat is fed onto a continuous strip of paper, which is folded transversely about the mat to form a continuous cigarette rod, which is then cut into cigarette portions, which in turn are subsequently cut and rolled to form a succession of normally filter-tipped cigarettes.

When cutting and rolling the cigarette portions, the tobacco particles inside tend to separate and spill from the ends of the cigarette portions. To eliminate this drawback, the continuous cigarette rod is so formed that, when cut into cigarette portions, the density of the tobacco at the ends of the cigarette portions is greater than that of the tobacco in the intermediate portions of the cigarette portions.

This is normally achieved, in units for forming a continuous mat of tobacco of the type described above, using pressure devices located downstream from the feed means to compact given portions of the continuous mat of tobacco, or using shaving disks, also located downstream from the feed means and having peripheral cavities arranged so that the mat of tobacco is shaved less or not at all at given areas spaced along the mat of tobacco with a spacing equal to the length of the cigarette portions to be produced.

Though widely used, the above methods do not always succeed in achieving the desired result, owing to the mat of tobacco simply comprising a totally heterogeneous bed of shredded dry leaves, whose response to external processing differs from one point to another.

To eliminate this drawback, as opposed to variously processing the mat of tobacco, it has been proposed to obtain denser portions along the mat by adding to the mat a succession of localized masses of tobacco. In U.S. Pat. Nos. 3,795,249 and 4,693,262, for example, denser portions are achieved by depositing on the conveyor belt, upstream from the feed means, extra amounts of tobacco, which are fed beforehand by further feed means to respective suction radial seats on a wheel external to the conveyor belt and positioned with a lateral surface tangent to the conveyor belt. By virtue of said suction means, the extra quantities of tobacco are deposited on the conveyor belt at the point of tangency between the wheel and the conveyor belt.

This solution obviously has major drawbacks, owing to the wheel being located outside the tobacco feed means. That is, transferring the masses of tobacco formed on the wheel to the conveyor belt seriously complicates the structure of the unit, and involves repeated handling of the shredded tobacco, thus reducing the quality of the finished cigarettes.

SUMMARY OF THE INVENTION

It is an object of the present invention to provide a unit for forming a continuous mat of tobacco with denser portions, designed to eliminate the aforementioned drawbacks.

According to the present invention, there is provided a unit for forming a continuous mat of tobacco with denser portions, the unit comprising a conveyor belt extending along a given path; first feed means located along said path and for feeding a first continuous stream of shredded tobacco onto said conveyor belt; and first suction means located on the opposite side of said conveyor belt to said first feed means, and cooperating with said first feed means to retain a continuous mat of shredded tobacco on said conveyor belt; and being characterized by comprising second feed means for feeding a second continuous stream of shredded tobacco onto said conveyor belt; and second suction means located on the opposite side of said conveyor belt to said second feed means, and cooperating with said second feed means to retain on said conveyor belt a succession of localized quantities of shredded tobacco spaced along said conveyor belt with the same spacing as said denser portions.

BRIEF DESCRIPTION OF THE DRAWING

The present invention will be described with reference to the accompanying drawing, which shows a partial section, with parts removed for clarity, of a preferred embodiment.

DETAILED DESCRIPTION OF THE INVENTION

Number 1 in the accompanying drawing indicates as a whole a cigarette manufacturing machine comprising a unit 2 for forming a continuous mat 3 of tobacco; and a unit 4 for receiving mat 3 from unit 2 and forming a continuous cigarette rod (not shown).

Unit 2 comprises a conveyor 5 defined by a belt 6 permeable to air and looped about a number of pulleys—at least one of which is a drive pulley 7 powered by a motor 8—for guiding belt 6 along an endless path P. For the sake of simplicity, in addition to pulley 7, the accompanying drawing shows only a guide pulley 9 and a return pulley 10, which are fitted to a frame 11 to rotate about respective parallel, horizontal axes 12 and 13. More specifically, return pulley 10 defines, along belt 6, the start of a substantially horizontal, straight bottom conveying branch 14, and the end of a top return branch 15.

Unit 2 also comprises a suction box 16 connected to a suction circuit 17, and having a perforated wall 18 which extends, in contact with a top surface of conveying branch 14, substantially from a point of tangency 19 between conveying branch 14 and the periphery of return pulley 10, and past a feed device 20 located beneath conveying branch 14 and comprising an upflow channel 21 for feeding onto the bottom surface of conveying branch 14 a continuous stream 22 of shredded tobacco, which, in use, is retained by suction on the bottom surface of conveying branch 14 to form mat 3 (only partly, as explained later on).

Return pulley 10 comprises an internal pneumatic distributor 23, in turn comprising a fixed annular plate 24 coaxial with axis 13 and having a curved suction cavity 25, which extends, anticlockwise in the drawing, about axis 13 along an arc of about 180° from point of tangency 19, communicates on one side with a suction circuit 26, and on the other side is positioned facing and tangent to an end surface of a wheel 27 forming part of pneumatic distributor 23 and having a hub 28 coaxial with axis 13 and fitted to the output shaft of a motor 29. Wheel 27 comprises an outer annular body 30 connected to hub 28 by spokes 31 defining a number of cavities 32, each of which moves past and communicates with suction cavity 25, and communicates with a respective radial passage 33 formed through annular body 30. Return pulley 10 also comprises a perforated annular jacket 34 coaxial with axis 13, fitted idly to annular body 30, and engaged externally by belt 6.

Unit 2 also comprises a further feed device 35, in turn comprising a downflow channel 36 for a stream 37 of shredded tobacco, which, in use, flows onto the portion of belt 6 extending along at least part of suction cavity 25.

In actual use, belt 6 is operated so that conveying branch 14 travels in a given direction 38 past the outlet of upflow channel 21, and so as to rotate jacket 34 about axis 13 at a given angular speed. At the same time, motor 29 is activated to rotate wheel 27 about axis 13 at an angular speed which is maintained substantially equal to the angular speed of jacket 34 by a known negative feedback control. As return pulley 10 rotates, the vacuum in suction cavity 25 is therefore transmitted, through jacket 34, to portions 39 of belt 6 aligned with radial passages 33, and more specifically with the radial passages 33 whose respective cavities 32 communicate instant by instant with suction cavity 25.

The particles in stream 37 of shredded tobacco fed along downflow channel 36 are therefore retained by portions 39 of belt 6, as portions 39 travel along suction cavity 25, so as to form, on belt 6 and at portions 39, a succession of tobacco quantities 40 equally spaced along belt 6 with a spacing equal to the length of the cigarette portions (not shown) being produced.

As return pulley 10 rotates, tobacco quantities 40 reach point of tangency 19 where suction through suction cavity 25, cavities 32, and radial passages 33 is replaced by suction through perforated wall 18 of suction box 16. As a result, quantities 40 travel past point of tangency 19 and together with conveying branch 14 in direction 38 past upflow channel 21, where quantities 40 are covered by the particles in stream 22 retained by suction on the underside of conveying branch 14. In other words, downstream from feed device 20, conveying branch 14 supports a continuous mat 3 of shredded tobacco having thicker portions 41 equally spaced with a spacing equal to the length of the cigarette portions (not shown), which are formed by a known cutting head (not shown) cutting a continuous cigarette rod (not shown) formed by feeding mat 3 onto a strip 42 of paper supplied by a conveyor 43 along unit 4, and by folding strip 42 of paper transversely (in known manner not shown) about mat 3.

In connection with the above, it should be pointed out that, to simply rotate wheel 27 synchronously with jacket 34, jacket 34 and wheel 27 need simply be made integral with each other, thus eliminating motor 29. Motor 29 and wheel 27, as shown, are provided, however, by constituting an adjusting device 44, which, by simply adjusting motor 29, provides for keeping quantities 40 spaced along belt 6 in time with the known cutting head (not shown), despite any stretch of belt 6 or slack of pulleys 7, 9 and 10.

The invention claimed is:

1. A unit for forming a continuous mat (3) of tobacco with denser portions (41), the unit (2) comprising:

a conveyor belt (6) extending along a given path (P);

first feed means (20) located along said path (P) and for feeding a first continuous stream (22) of shredded tobacco onto said conveyor belt (6);

first suction means (16, 17) located on the opposite side of said conveyor belt (6) to said first feed means (20), and cooperating with said first feed means (20) to retain a continuous mat (3) of shredded tobacco on said conveyor belt (6);

second feed means (35) for feeding a second continuous stream (37) of shredded tobacco onto said conveyor belt (6); and second suction means (10, 26) located on the opposite side of said conveyor belt (6) to said second feed means (35), comprising a return suction pulley (10) for returning said conveyor belt (6) along said path (P) and cooperating with said second feed means (35) to retain on said conveyor belt (6) a succession of localized quantities (40) of shredded tobacco spaced along said conveyor belt (6) with the same spacing as said denser portions (41).

2. A unit as claimed in claim 1, wherein said second suction means (10, 26) are located upstream from said first suction means (16, 17) in a travelling direction (38) of said conveyor belt (6) along said path (P).

3. A unit as claimed in claim 1, and comprising regulating means (44) for regulating distribution of said localized quantities (40) of shredded tobacco along said conveyor belt (6).

4. A unit as claimed in claim 1, wherein said suction pulley (10) comprises an inner annular distributor (23) having an axis (13); a fixed suction chamber (25); an annular body (30) mounted to rotate about said axis (13) and past said suction chamber (25), and having a number of equally spaced radial passages (33); and an outer jacket (34) permeable to air, fitted to said annular body (30), coaxially with said axis (13), and engaged externally by said conveyor belt (6).

5. A unit as claimed in claim 4, wherein said jacket (34) is fitted idly to said annular body (30) and rotated about said axis (13) by said conveyor belt (6).

6. A unit as claimed in claim 4, wherein said regulating means (44) comprise actuating means (29) for moving said annular body (30) angularly about said axis (13) with respect to said outer jacket (34).

* * * * *